US005388710A

United States Patent [19]

Sawyer

[11] Patent Number: 5,388,710

[45] Date of Patent: Feb. 14, 1995

[54] DISPLAY DEVICE FOR FAN PULLS

[76] Inventor: Gerald F. Sawyer, 2862 Tree Top Rd., Dacula, Ga. 30211

[21] Appl. No.: 209,908

[22] Filed: Mar. 14, 1994

[51] Int. Cl.[6] ..... A47F 7/00

[52] U.S. Cl. ..... 211/113; 211/115

[58] Field of Search ..... 211/113, 115; D6/521, D6/513, 457

[56] References Cited

U.S. PATENT DOCUMENTS

D. 328,204 7/1992 Todd ..... D6/457

D. 346,289 4/1994 Todd ..... D6/457

*Primary Examiner*—Alvin C. Chin-Shue

*Assistant Examiner*—Sarah Purol

*Attorney, Agent, or Firm*—James B. Middleton

[57] ABSTRACT

A merchandising display device for fan pulls provides a transparent disk carried by a ceiling fan. The disk has a plurality of hook members depending therefrom for receiving a fan pull. The hook members include a mounting flange fixed to the disk, and a depending hook. The hook defines a slot for receiving the chain attached to a fan pull. A stud centrally of the disk fixes the disk to the light adapter of the fan.

5 Claims, 1 Drawing Sheet

DISPLAY DEVICE FOR FAN PULLS

BACKGROUND OF THE INVENTION

1. Field of the Invention

This invention relates generally to merchandising display devices, and is more particularly concerned with a merchandising display for fan pulls and the like.

2. Discussion of the Prior Art

For many years there have been devices that are attached to the string, or chain, for turning a fan on and off, or changing speeds. Traditionally the devices are simply spheres or other common shapes and objects. Such devices have been sold as necessities, and there has been no creative merchandising of the devices.

More recently, the field of fan pulls has blossomed, largely because of the renewed popularity of ceiling fans, and the introduction of adapters that allow a lamp finial to be used as a fan pull. With the expanding market for fan pulls there have been some efforts at aggressive merchandising of fan pulls. Such merchandising efforts have taken the form of displaying the fan pulls in a display box or the like wherein the fan pull is displayed as a work of art. While this shows the fan pull itself, it does not display the fan pull in the proper setting so a potential customer can see the fan pull in the environment in which it will be used.

SUMMARY OF THE INVENTION

The present invention provides a merchandising display device including a base member carried by a fan. The base member is disposed generally horizontally and mounts a plurality of attaching means, each attaching means being adapted to receive a conventional fan pull.

The conventional fan pulls are fixed to a bead chain, so the attaching means of the present invention is preferably a means for receiving a bead chain. In one embodiment of the invention, the attaching means comprise hook members having a slot for receiving the connecting link, while the hook receives the end bead on a bead chain.

Thus, the present invention provides a base member carried by a fan or the like; and, the base member, through the attaching means, supports a plurality of fan pulls. As a result, each fan pull is displayed so that a potential customer can see the fan pull in the environment in which it will be used; and, the fan pulls can be very prominently displayed in a retail store to attract the impulse shopper, or to remind a shopper to purchase a fan pull.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
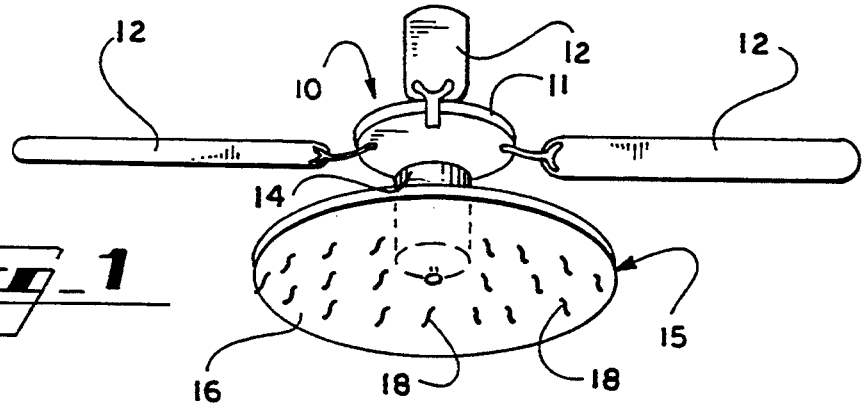
FIG. 1 is a perspective view showing a merchandising device made in accordance with the present invention mounted on a fan.

Referring now more particularly to the drawings, and to that embodiment of the invention here presented by way of illustration, FIG. 1 shows a conventional ceiling fan 10 having a fan motor 11 and fan blades 12. Below the blades 12 there is a connector 14 to which a lighting fixture can be mounted. Those skilled in the art will understand that the connector 14 has a threaded opening in its bottom surface, the opening being adapted to receive a standard threaded nipple for mounting the lighting fixture. This opening is used for mounting the device of the present invention. The merchandising display device 15 of the present invention includes a base member 16 having a plurality of attaching means 18 thereon. Each of the attaching means 18 can mount a fan pull, so a large number of fan pulls can be displayed on one of the devices 15.

Figure 2:
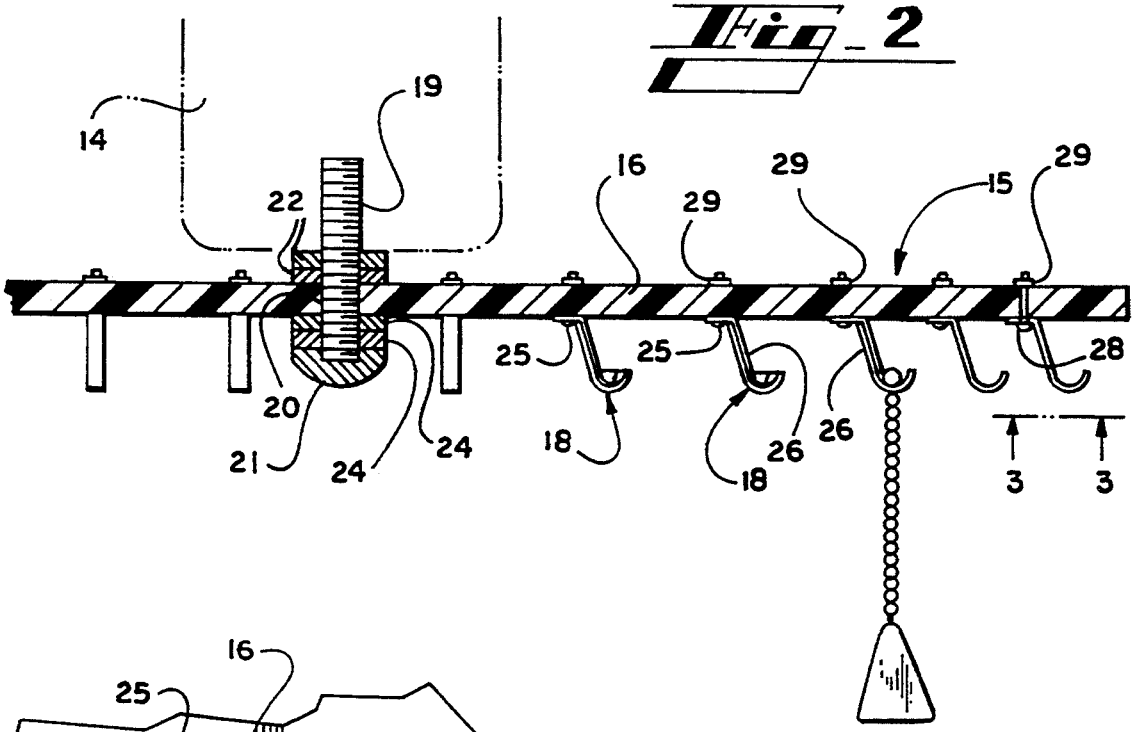
FIG. 2 is an enlarged cross-sectional view taken diametrically through the merchandising device illustrated in FIG. 1; and, FIG. 3 is an enlarged, fragmentary view taken substantially along the line 3—3 in FIG. 2.

Attention is now directed to FIG. 2 of the drawings where the construction of the merchandising device 15 is shown in more detail. The base member 16 is simply a flat piece of material, plate-like in shape, here indicated as polymeric material. Those skilled in the art will understand that many different materials can be used, including plywood, pressboard, metal and the like; however, the preferred embodiment of the invention utilizes a transparent plastic such as an acrylic or styrene. Methylmethacrylate is readily available, and is strong and durable, and well suited for use as the base member. The base member 16 is here shown as being circular in plan view. While this is the preferred shape for congruence with the fan, it will be readily understood that other shapes can also be used. A hexagon or an octagon would be an obvious substitution, but of course a rectangle or other shape can also be used, including free-form shapes.

To mount the device 15 of the present invention on a fan such as the fan 10, there is a stud 19 passing through a hole 20 in the base member 16. As is mentioned above, the hole in the connector 14 is a standard size with a standard thread, so a stud 19 that is threadably receivable in such hole can be provided.

Since the connector 14 is designed to receive a threaded nipple, such a nipple is here used as the stud 19. The stud 19 preferably has a head 21 that is attractive, and this is provided by a cap 21 which is readily available and threadable onto the stud 19. The stud 19 is fixed to the base member 16 by providing at least one nut on each side of the base member 16, the nuts being here indicated at 22 and 24. While one such nut may be used, the use of two provides a locking arrangement without the necessity for lock washers or the like. Also, those skilled in the art will realize that most of the readily available nuts are quite thin, so two or more of the nuts can be used together for strength, or for appearance.

As is illustrated in FIG. 1, there is a plurality of attaching means 18 on the base member 16. FIG. 2 shows the attaching means 18 somewhat better, and shows that each of the attaching means includes a mounting flange 25 and a depending hook 26. The mounting flange 25 is fixed to the base member 16 by a screw 28 passing through the flange 25, the screw 28 threadedly receiving a nut 29. Those skilled in the art will realize that other fastening means, such as rivets, brads and the like, may be used in lieu of the screws 28.

Figure 3:
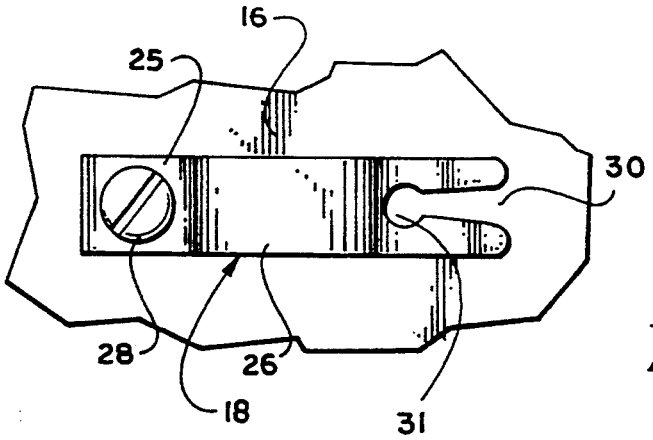

Looking at FIG. 3 of the drawings, it can be seen that the hook member 26 defines a slot 30 in its extremity. The slot 30 allows entry of the bead chain attached to a fan pull; and, it will be noticed that the slot 30 is tapered for easy entrance of the chain into the slot 30. A bead chain is of course made up of a plurality of beads, with short links between the beads. The slot 30 is designed to receive the short link between two beads, and one of the beads will be received on the hook 26. The bead will then rest in the larger opening 31 so the fan pull sits in one location. Thus, the opening 31 must be smaller than a bead of the chain, but large enough for a bead to nest in the opening 31.

With the above and foregoing description in mind, it should be understood that the present invention provides a very simple and attractive merchandising display for fan pulls and the like. Furthermore, the device allows fan pulls to be prominently displayed where potential customers will be reminded of them, or informed of them, to promote impulse purchases as well as planned purchases.

The base member of the present invention may be of any practical size desired, but one successful embodiment of the invention is about 12 inches, or 310 mm., in diameter, and about 3/16 inch, or 5 mm. in thickness. The attaching means need to be spaced apart enough for attractive display of the fan pulls, and a spacing of around 2 inches, or 50 mm., is generally sufficient. Somewhat smaller spacing may be used so long as overall crowding is avoided.

It will therefore be understood by those skilled in the art that the particular embodiment of the invention here presented is by way of illustration only, and is means to be in no way restrictive; therefore, numerous changes and modifications may be made, and the full use of equivalents resorted to, without departing from the spirit or scope of the invention as outlined in the appended claims.

I claim:

1. A merchandising display device for fan pulls in combination with a fan, said fan including a plurality of blades, and a connector below said blades, said device comprising a base member fixed to said connector, and a plurality of attaching means on said base member, each attaching means of said plurality of attaching means including hook means for receiving a fan pull.

2. A merchandising display device as claimed in claim 1, wherein said base member comprises a plate-like member disposed in a horizontal plane, and including a stud centrally of said base member for attaching said base member to said connector.

3. A merchandising display device as claimed in claim 2, wherein said hook means are depending from said base member and each hook means defines a slot in its terminal end.

4. A merchandising display device as claimed in claim 3, wherein said base member is formed of transparent material.

5. A merchandising display device as claimed in claim 4, wherein said base member is circular in plan view, and said stud is at the center thereof.

* * * * *